United States Patent [19]

Weideburg

[11] Patent Number: 4,768,294

[45] Date of Patent: Sep. 6, 1988

[54] DEVICE FOR TRANSFERRING A PAPER OR BOARD WEB FROM THE PRESS SECTION TO THE DRYER SECTION OF A PAPER MACHINE

[75] Inventor: Reinhold H. Weideburg, Heidenheim, Fed. Rep. of Germany

[73] Assignee: J. M. Voith, GmbH, Heidenheim, Fed. Rep. of Germany

[21] Appl. No.: 941,404

[22] Filed: Dec. 15, 1986

[30] Foreign Application Priority Data

Dec. 17, 1985 [DE] Fed. Rep. of Germany ..... 3544541

[51] Int. Cl.[4] ..... F26B 13/08

[52] U.S. Cl. ..... 34/116; 34/117; 34/120; 34/123

[58] Field of Search ..... 34/114, 116, 117, 120, 34/122, 123

[56] References Cited

U.S. PATENT DOCUMENTS

| | | | |
|---|---|---|---|
| 3,280,476 | 10/1966 | Hildebrand | 34/13.8 |
| 3,874,997 | 4/1975 | Kankaanpaa . | |
| 4,000,035 | 12/1976 | Schiel et al. . | |
| 4,014,740 | 3/1977 | Koponen et al. . | |
| 4,183,148 | 1/1980 | Koski et al. | 34/116 |
| 4,359,827 | 11/1982 | Thomas | 34/114 |
| 4,359,828 | 11/1982 | Thomas | 34/114 |
| 4,543,160 | 9/1985 | Kerttula et al. . | |
| 4,551,203 | 11/1985 | Eskelinen | 34/114 |
| 4,566,946 | 1/1986 | Koponen et al. | 34/114 |
| 4,625,430 | 12/1986 | Aula et al. | 34/123 |

*Primary Examiner*—L. I. Schwartz

*Attorney, Agent, or Firm*—Albert L. Jeffers

[57] ABSTRACT

A paper machine or similar apparatus is provided with a device for transferring a paper or board web from a press section to a dryer section on an endless, machine-wide support belt. The belt operates over a guide roll in the press section and a drying cylinder of the dryer section. Transfer of the paper or board web is improved, especially for heavy grades, with regard to the open draw length, the web stretch and web drying. The drying cylinder, guide roll and endless support belt looped therearound are interposed between the press section and first cylinder drying group, which is not drivingly coupled to the first cylinder. A clothing generally looped around and operable with the first cylinder drying group contacts the endless support belt for transfer of the web.

7 Claims, 1 Drawing Sheet

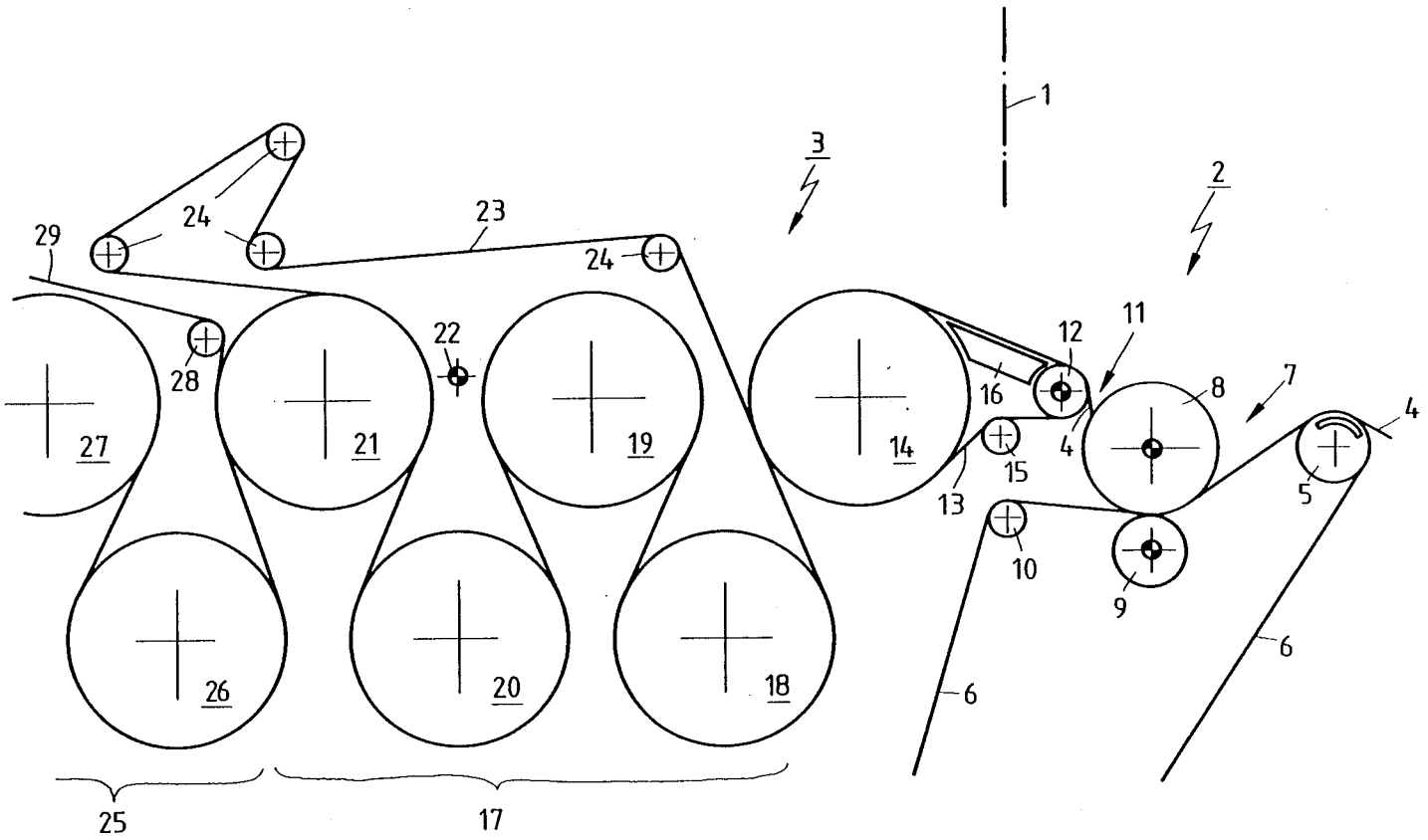
1
2
3
4
5
6
7
8
9
10
11
12
13
14
15
16
17
18
19
20
21
22
23
24
25
26
27
28
29

DEVICE FOR TRANSFERRING A PAPER OR BOARD WEB FROM THE PRESS SECTION TO THE DRYER SECTION OF A PAPER MACHINE

BACKGROUND OF THE INVENTION

1. Field of the Invention

The invention concerns a device for transferring a paper or board web from the press section to the dryer section of a paper machine or similar device.

2. Prior Art

German patent publication, corresponding to U.S. Pat No. 4,000,035, 23 65 438 teaches retrieval of a paper web proceeding through a press from a stone roll and transferring it after a short open draw, by a suction roll, to the upper section of a support belt. The support belt runs over all the drying cylinders of a first drying cylinder group and passes the web to the next drying cylinder group. If a greater web stretch is desired for specific paper grades, this design requires the stretch to be carried out primarily in the open draw between the stone foll and the suction roll. The next possible pull adjustment is in the open draw of the web between the first and the subsequent drying cylinder group. The fact that the wet paper web makes direct contact with the second drying cylinder is a disadvantage to drying the web. The second cylinder must only be moderately heated to avoid an excessive accumulation of paper particles on it. The long support belt section during return travel causes heavy cooling of it. Finally, an open draw of greater length, which may result from a modification of the press section, can be compensated for in this device only by altering the lead of the support belt in the first drying cylinder group.

Continuing efforts are being made to improve the transfer of paper or board web, especially for heavy grades, with regard to the open draw length, web stretch, and web drying.

SUMMARY OF THE INVENTION

The present invention provides a solution to the above-noted problem. Control of the web draw in the open draw lengths of the web, both between the press and the guide roll and between the drying cylinder and drying cylinder group, is accomplished by separating the drive of the drying cylinder from the group drive.

Separating the drying cylinder from the drying cylinder group makes it possible to shorten the latter, thereby reducing wrinkling and flutter. The relatively short support belt is better adapted to the transfer function than a belt convering the entire drying cylinder group.

The return section of the support belt is relatively short and, therefore, is only subject to slight cooling, which improves heating and drying of the web by the support belt and drying cylinder.

In a drying cylinder group with a single felt, only the second drying cylinder of this group, i.e., the third drying cylinder of the dryer section, has immediate contact with the web. This third cylinder can be run hotter because the danger of paper particle accumulation is reduced. The press section can be inexpensively modified to adapt the device to modify the open draws by modification of the guide roll arrangement and support belt length.

A further embodiment of the invention provides easily controllable drive for the drying cylinder through the support belt.

German patent publication corresponding to U.S. Pat. No. 4,014,740 discloses guide rolls with their own drive means. These guide rolls are arranged between the press section and the dryer section of a paper machine to transfer the paper webs. The guide rolls are not used to drive other machine elements.

BRIEF DESCRIPTION OF THE DRAWING

The single FIGURE of the drawing shows a schematic section of a paper or board machine.

DETAILED DESCRIPTION OF THE INVENTION

A preferred embodiment of the invention is explained hereafter with reference to the drawing. In the drawing the transition between the press section 2 and the dryer section 3 of a paper machine is indicated by vertical dash-dot line 1. The paper machine is operable from right to left and in the press secton 2 web 4 is transferred from a suction roll 5 on a press felt 6. Web 4 is now running on the top side of the press felt 6 and is passed to a press 7 with an upper roll 8 and a lower roll 9. Upper roll 8 is a natural or artificial stone roll. Press felt 6, exiting from the press gap between upper roll 8 and lower roll 9, is passed downward over a guide roll 10, while moist web 4 clings to the circumference of the upper roll 8. Web 4 is retrieved in the upper circumferential half of roll 8, negotiates a relatively short open draw 11 in the area of a guide roll 12, and is transferred to a support belt 13. Support belt 13 is relatively short and consists of a drying screen with a relatively smooth surface, good properties for transfer of web 4 from the belt, and a heat storage capability that is as high as possible. Situated in the loop of the support belt 13 is a guide roll 12 and a drying cylinder 14. The return section of the support belt 13 runs over a guide and regulating roll 15.

Guide rolls 12 is equipped with its own drive or drive means (indicated by the circle with two opposed black quadrants). Thus, drying cylinder 14 is driven by support belt 13, which is driven by the guide roll 12, at the required peripheral speed.

An air deflection device 16, which borders on the upper belt section, is arranged between guide roll 12 and drying cylinder 14, inside the loop of the endless, machine-wide support belt 13. Device 16 consists of a hollow box with a top side close to support belt 13, which top side is either open or provided with perforations. Air deflection device 16, which is connected to a vacuum pump, is mounted in the gap between support belt 13 and the circumferential surfaces of the guide roll 12 and drying cylinder 14. A vacuum in the air deflection device 16 draws the air between the top side of belt 13 and web 4 through the support belt 13, which air effects the transfer of the web on the support belt. The air deflection device 16 could also be fashioned as a scraper with foil type slats to capture the air layer entrained on the bottom side of support belt 13 along its upper section. This structure would provide a suction effect on top side of belt 13, too.

The first drying cylinder 14 of the dryer section 3 is followed by a first drying cylinder group 17 with drying cylinders 18, 19, 20, and 21. The cylinders of this drying cylinder group 17 are powered by a group drive indicated by symbol 22. The drying cylinder group 17 is provided with a clothing 23, such as a contact screen or felt, which moves over the four drying cylinders 18 through 21. Drying cylinders 18 and 20 are located within the loop of the clothing 23; and, drying cylinders 19 and 21 are located ouside the loop of clothing 23. The four guide rolls 24 operate to guide and control clothing 23. Support belt 13 loops around drying cylinder 14 and contacts clothing 23 of first drying cylinder group 17, before clothing 23 runs over first drying cylinder 18 of group 17. The first drying cylinder group 17 is followed by a second drying cylinder group 25, however, only the drying cylinders 26 and 27 are visible in the drawing. The cylinders of the second drying cylinder group 25 are also provided with a single screen or single felt, shown as clothing 29, which is operable over guide rolls 28.

After partially looping around drying cylinder 14, web 4 is transferred to clothing 23 of first drying cylinder group 17 and passes over drying cylinders 18, 19, 20, and 21 of group 17. Web 4 loops around the outside of drying cylinder 18 on clothing 23, which cylinder 18 is the second cylinder of dryer section 3. Similarly, web 4 runs on the outside of lower drying cylinders 20 and 26 of the dryer section 3. However, web 4 directly contacts third drying cylinder 19, and drying cylinders 21 and 27 of dryer section 3. After passing through the first drying cylinder group 17, web 4 is transferred from drying cylinder 21 to clothing 29 of the second drying cylinder group 25, etc.

Web 4 can be stretched in open draw 11 and in the transfer between drying cylinders 14 and 18. An exact partition of stretch between the two transfer areas is readily attained through drive control of drying cylinder 14 by guide roll 12, which is independent of drive 22 of first drying cylinder group 17. Therefore, a differential speed of web 4 between press 7 and support belt 13, and between drying cylinder 14 looped by support belt 13 and clothing 23 of the first drying cylinder group 17, can be varied. The stretch of the web 4 can be safely adjusted in the area between cylinders 74 and 78 as the web travels nearly vertical and does not sag.

The open draw 11 between the upper roll 8 of press 7 and guide roll 12 can be changed by modifying press section 2. This modification can be accommodated by shifting guide roll 12 and changing the support belt length. When the distance between guide roll 12 and drying cylinder 14 becomes greater, the travel of support belt 13 can be adjusted in the area of the upper section by incorproating another guide roll (not shown). Several air deflection devices 16 can be inserted between the guide rolls although only one is illustrated in the drawing.

Paper or board web is also suitable for a press where both the lower roll and the upper roll are each equipped with a press felt. Guide roll 12 must then be arranged in the area where the press felts exit from the press.

Clothing 23, disclosed as single screen or single felt in dryer section 3, may be a conventioal clothing of two felts or screens independently run over the outside circumferential half of the upper and the lower drying cylinder rolls.

Those skilled in the art will recognize that certain variations can be made in the illustrated embodiments. While only specific embodiments of the invention have been described and shown, it is apparent that various alterations and modifications can be made therein. It is, therefore, the intention in the appended claims to cover all such modifications and alterations as may fall within the true scope and spirit of the invention.

What is claimed is:

1. A device for transferring one of a paper web and board web in a paper machine having: a press section including a press, a dryer section, an endless machine-wide support belt, which belt operates over a guide roll arranged in said press section and at least one drying cylinder of said dryer section, and an open draw section between said press and said support belt, said transfer device having an upper segment and comprising:

a drying cylinder;

a first cylinder drying group, with at least two drying cylinders and a clothing generally looped around and operable with said first cylinder drying group;

said endless support belt looped around and operable with said drying cylinder and said guide roll between said press section and said first cylinder drying group;

said web contacting said support belt at said transfer device upper segment; and said support belt contacting said clothing of said first cylinder drying group for transfer of said web upstream of the first drying cylinder fo said first drying cylinder group.

2. A device for transferring one of a paper web and board web in a paper machine as claimed in claim 1 wherein said guide roll is operable with an independent drive.

3. A device for transferring one of a paper web and board web in a paper machine as claimed in claim 1 wherein said endless support belt defines a loop and an upper segment between said guide roll and said drying cylinder and at least one air deflection device is mounted within the loop in proximity to said upper support segment.

4. A device for transferring one of a paper web and board web in a paper machine having a press section and a dryer section, said transfer device comprising:

a guide roll in said press section, a drying cylinder in said drying section, an endless belt surrounding said guide roll and said drying cylinder, said endless belt operable to transfer said web from said press section to said dryer section;

a first cylinder drying group with a clothing generally looped around and operable with said first cylinder group;

said endless belt tangentially contacting said first cylinder drying group clothing to transfer said web to said clothering;

said endless belt defining an upper section between said guide roll and said drying cylinder; and at least one air deflection device in proximity to said endless belt and arranged within the loop of said endless belt.

5. A device for transferring one of a paper web and board web in a paper machine having a press section and a dryer section as claimed in claim 4 wherein said air deflection device is operable with a vacuum pump.

6. A device for transferring one of a paper web and a board web in a paper machine having a press section and a dryer section as claimed in claim 4 wherein said air deflection device is provided with foil-type slats for capture of an entrained air layer near said endless support belt.

7. A device for transferring one of a paper web and board web in a paper machine having a press section and a dryer section, said transfer device comprising:

a guide roll in said press section, at least one drying cylinder in said drying section, an endless belt surrounding said guide roll and said at least one drying cylinder, said endless belt operable to transfer said web from said press section to said dryer section;

an independent drive means coupled to said guide roll;

said dryer section including at least one drying cylinder and a group drive means for driving said cylinder; and said group drive means and said independent drive means of said at least one drying cylinder of said transfer device are operable to stretch said web between said transfer device and said dryer section.

* * * * *

UNITED STATES PATENT AND TRADEMARK OFFICE

CERTIFICATE OF CORRECTION

PATENT NO. : 4,768,294

DATED : September 6, 1988

INVENTOR(S) : Reinhold H. Wiedeburg

It is certified that error appears in the above-identified patent and that said Letters Patent is hereby corrected as shown below:

Col. 1, line 13, after "publication" insert --no. 23 65 438--;
Col. 1, line 14, delete "23 65 438";
Col. 1, line 23, change "foll" to --roll--;
Col. 1, line 53, change "convering" to --covering--;
Col. 2, line 4, after "publication" insert --no. 25 38 846--;
Col. 2, line 41, change "rolls" to --roll--;
Col. 3, line 50, change "incorproating" to --incorporating--;
Col. 3, line 59, change "conventioal" to --conventional--;
Claim 1, Col. 4, line 24, change "fo" to --of--;
Claim 4, Col. 4, line 51, change "clothering" to --clothing--.

Signed and Sealed this

Tenth Day of January, 1989

*Attest:*

*Attesting Officer*

DONALD J. QUIGG

*Commissioner of Patents and Trademarks*